US009004797B2

(12) United States Patent
Watson

(10) Patent No.: US 9,004,797 B2
(45) Date of Patent: Apr. 14, 2015

(54) BRUSH WITH ROTATABLE HANDLE

(71) Applicant: JoAnn Watson, Lake Forest, CA (US)

(72) Inventor: JoAnn Watson, Lake Forest, CA (US)

( * ) Notice: Subject to any disclaimer, the term of this patent is extended or adjusted under 35 U.S.C. 154(b) by 0 days.

(21) Appl. No.: 14/142,400

(22) Filed: Dec. 27, 2013

(65) Prior Publication Data

US 2014/0189971 A1 Jul. 10, 2014

Related U.S. Application Data

(60) Provisional application No. 61/848,324, filed on Dec. 31, 2012, provisional application No. 61/962,702, filed on Nov. 14, 2013.

(51) Int. Cl.
*A46B 5/00* (2006.01)
*A46B 11/00* (2006.01)

(52) U.S. Cl.
CPC ..... *A46B 5/0033* (2013.01); *A46B 11/002* (2013.01); *A46B 2200/104* (2013.01)

(58) Field of Classification Search
CPC .... A46B 11/001; A46B 17/04; A46B 5/0033; A46B 5/0041; A45D 44/18
USPC ..... 15/203, 159.1–160
See application file for complete search history.

(56) References Cited

U.S. PATENT DOCUMENTS

| | | | | |
|---|---|---|---|---|
| 1,727,007 | A * | 9/1929 | Eyster | 132/313 |
| 1,831,667 | A | 11/1931 | Johnson | |
| 2,097,938 | A * | 11/1937 | Sundin | 132/121 |
| 2,695,416 | A * | 11/1954 | Raimo | 15/106 |
| 2,850,753 | A * | 9/1958 | Pelletier | 15/185 |
| 3,516,424 | A * | 6/1970 | Eagle | 132/148 |
| 4,116,205 | A * | 9/1978 | Owen et al. | 132/313 |
| 4,289,153 | A | 9/1981 | Paccione | |
| 4,716,915 | A | 1/1988 | Burns | |
| 5,746,531 | A | 5/1998 | Izhak | |
| 6,196,235 | B1 * | 3/2001 | Kim | 132/148 |
| 6,213,129 | B1 | 4/2001 | Muldoon | |
| 7,309,182 | B2 | 12/2007 | McKay | |
| D634,126 | S * | 3/2011 | Viola | D4/116 |
| 2007/0212157 | A1 * | 9/2007 | Hoadley et al. | 401/136 |

FOREIGN PATENT DOCUMENTS

| | | |
|---|---|---|
| EP | 0063668 | 11/1982 |
| JP | 2011024976 | 2/2011 |

* cited by examiner

*Primary Examiner* — Sarah B McPartlin
(74) *Attorney, Agent, or Firm* — Kafantaris Law Offices; Theo Kafantaris

(57) ABSTRACT

A rotatable brush having a brush head and a handle pivotally connected to the brush head, whereby the handle is rotatable relative to the brush head between an unfolded position lying end-to-end and axially aligned with the brush head and a compact folded position lying below the brush head. The brush head has a locking cavity formed therein and the handle has a locking rib formed thereon. The locking rib is removably received within the locking cavity by which the brush head and the handle are retained one above the other when the handle is rotated to its folded position below the brush head. The handle includes a hollow fluid chamber running therethrough. A spray pump is detachably connected to the handle so that a spray tube communicates with the hollow fluid chamber to enable a fluid to be sprayed therefrom.

13 Claims, 5 Drawing Sheets

BRUSH WITH ROTATABLE HANDLE

CROSS-REFERENCE TO RELATED APPLICATIONS

This patent application is related to Provisional Patent Application Nos. 61/848,324 filed Dec. 31, 2012 and 61/962,702 filed Nov. 14, 2013.

BACKGROUND OF THE INVENTION

1. Field of the Invention

This invention relates to a rotatable (i.e., folding) brush having a brush head and a handle pivotally connected to the brush head, whereby the handle is rotatable relative to the brush head between an unfolded position lying end-to-end and axially aligned with the brush head and a compact folded position lying below the brush head. A spray pump is detachably connected to a refillable fluid chamber formed in the handle to enable a fluid to be sprayed therefrom.

2. Background Art

Hair brushes used for brushing an individual's hair are usually carried in a purse, a sack or even the user's pocket. On occasion, it is desirable to have access to a liquid to treat the user's hair prior, during or after brushing. For example, the user may wish to apply water, hair spray or the like to his/her hair. In this case, in addition to the hair brush, a separate liquid-filled container must also be carried. As a consequence of the foregoing, the user's purse, sack or pocket may become undesirably cluttered with hair care and other products.

In this same regard, in cases where a separate liquid-filled container need not be carried in addition to a hair brush, many brushes are long and bulky. The size of such hair brushes, in and of itself, contributes to the consumption of space within the user's purse, sack or pocket to often make it difficult to efficiently carry additional items therein.

Accordingly, what is desirable is a hair brush in which a liquid-filled spray pump is integrated to avoid the necessity of having to carry a separate liquid container. Also desirable is a hair brush that is adapted to be reduced to a compact size for easy storage and transport when the brush is not in use.

SUMMARY OF THE INVENTION

In general terms, a rotatable (i.e., folding) hair brush is disclosed having a brush head and a handle pivotally connected to the brush head, whereby the handle is rotatable relative to the brush head between an unfolded position lying end-to-end and axially aligned with the brush head and a folded position lying below the brush head. Opposing ends of the brush head and the handle have a pair of complementary locking lips that are snapped together to hold the hair brush in its unfolded position ready for use.

The bottom of the brush head has a locking cavity formed therein. A pair of locking edges or catches project into the locking cavity from opposite sides thereof. A pair of grooves are formed along the handle such that a locking rib is established between the grooves at the bottom of the handle. When the brush is not in use, the handle may be rotated in a first direction around a hinge that is located between the opposing ends of the handle and the brush head. The handle is thusly moved to its folded position below the brush head so that the brush head and the handle are arranged one above the other. In this case, the locking rib at the bottom of the handle will be rotated into removable receipt by the locking cavity formed at the bottom of the brush head. The pair of locking edges along the sides of the locking cavity are snapped into detachable mating engagement with respective ones of the grooves at opposite sides of the locking rib. Accordingly, the handle will be retained in its folded position underneath the brush head to create a compact brush assembly suitable for transport and storage. The handle may be rotated in an opposite direction by which to pull the locking rib out of the locking cavity and thereby return the handle to its unfolded position.

The handle includes an integral refillable fluid chamber running therethrough to be filled with water or a hair care product. A spray pump is detachably connected to the handle at an open end thereof. The spray pump has a pump head and a spray tube which extends from the pump head and lies in fluid communication with the fluid chamber of the handle. By operating (i.e., depressing) the pump head, the contents of the fluid chamber may be sprayed therefrom by way of the spray tube.

DESCRIPTION OF THE PREFERRED EMBODIMENT

A rotatable (i.e., folding) brush 1 according to a preferred embodiment of this invention is described while referring concurrently to FIGS. 1-5 of the drawings. The brush 1 herein described is preferably one that is commonly used to brush an individual's hair. However, it should be understood that the application of the brush 1 is not to be considered a limitation of this invention. Therefore, the brush 1 can also be used to brush a variety of contact surfaces such as, but not limited to, a pet, a wall, clothing, and the like.

Figure 1:
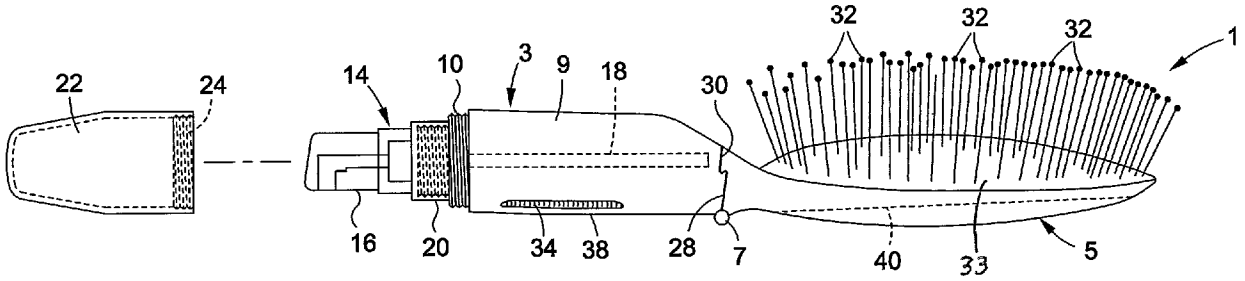
FIG. 1 shows a rotatable brush according to a preferred embodiment of this invention having a handle that is in an unfolded axially-aligned position relative to a brush head.
Figure 3:
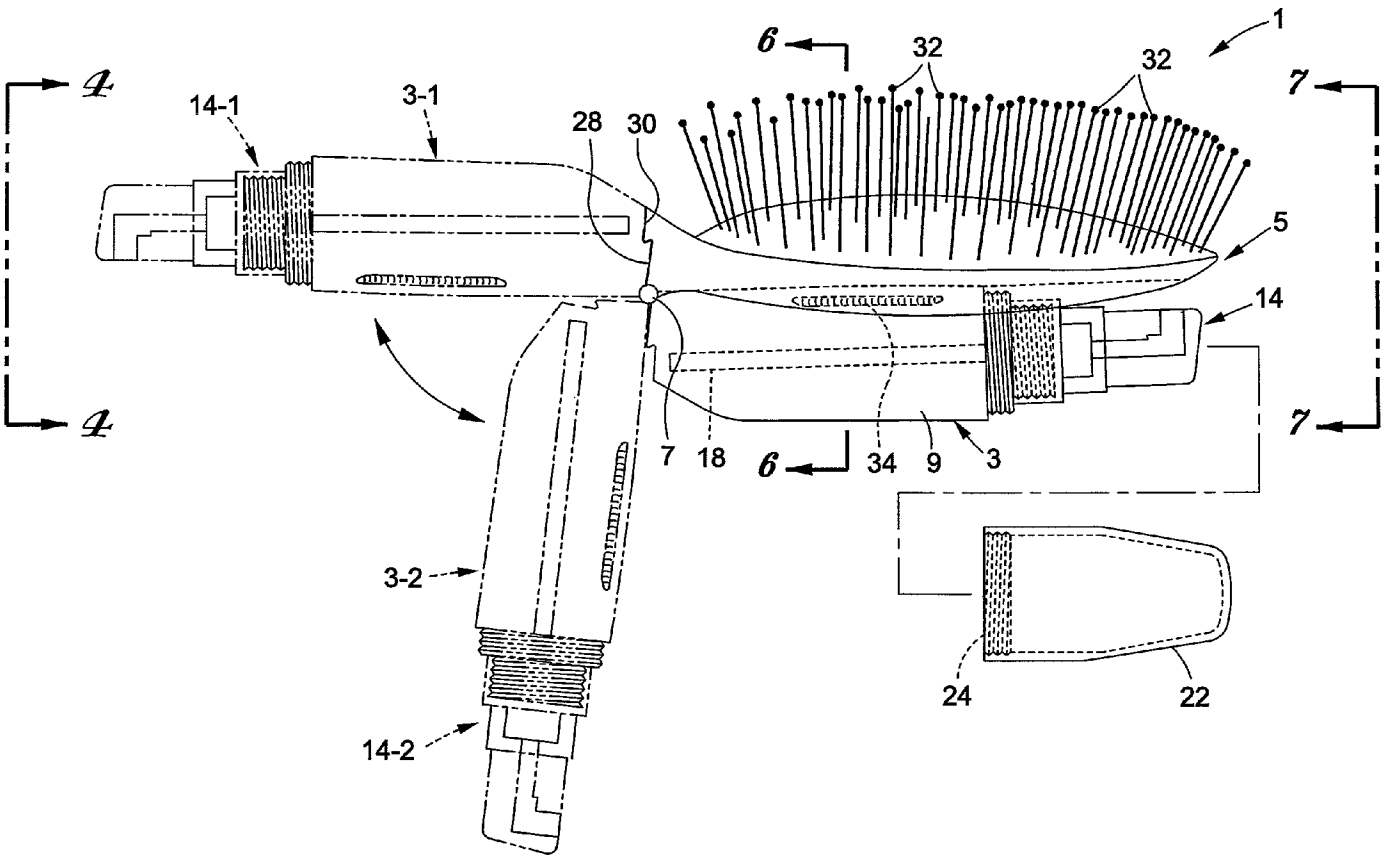
FIG. 3 illustrates the handle of the rotatable brush being rotated at a hinge from its unfolded position of FIG. 1 to a folded position lying below the brush head.

As will be described in greater detail hereinafter, the rotatable brush 1 has a handle 3 located at one end thereof that is connected and rotatable relative to a brush head 5 located at the opposite end. In particular, the handle 3 and brush head 5 are pivotally coupled together at a hinge 7 located at opposing ends thereof so that the handle 3 can be rotated between an unfolded position axially aligned with the brush head 5 as shown in FIG. 1 and a compact, folded position lying below the brush head 5 as shown in FIG. 3, whereby the brush head and handle lie one above the other. Each of the handle 3 and brush head 5 are preferably manufactured from a durable, impact-resistant material such as plastic, or the like.

Figure 5:
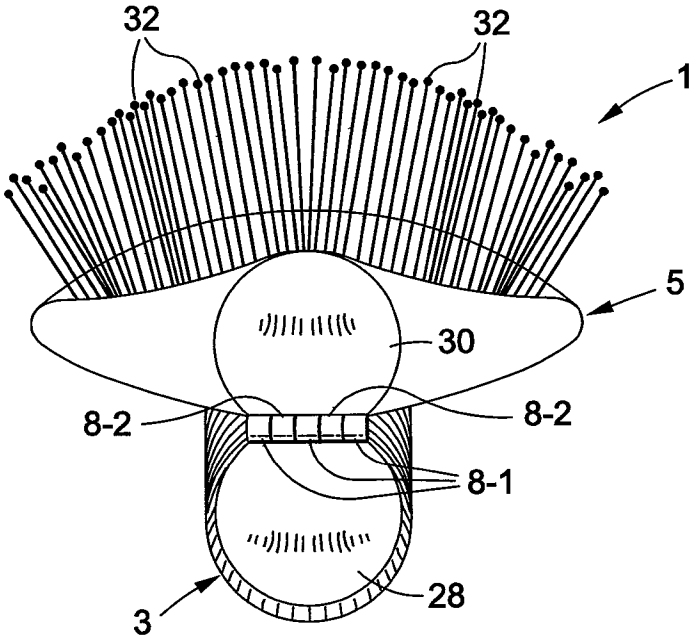
FIG. 5 is the same end view of the rotatable brush as shown in FIG. 4 but with the handle rotated around a different hinge to be retained in its folded position.
Figure 4:
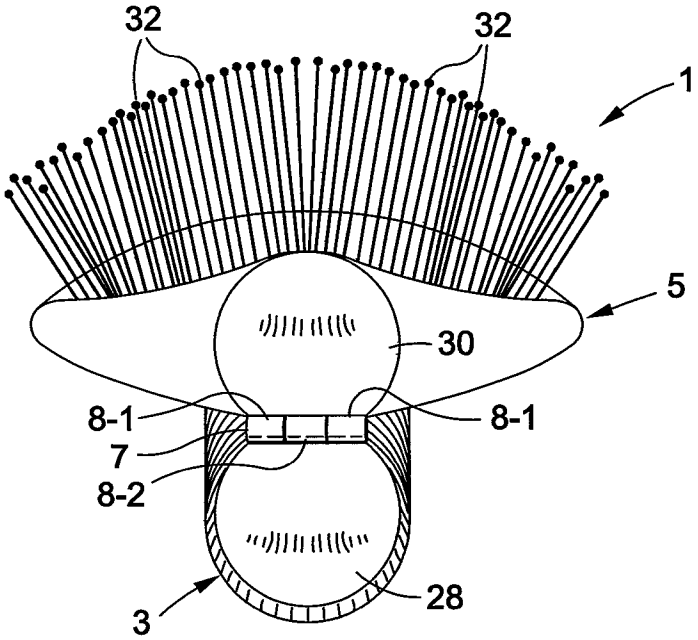
FIG. 4 is an end view of the rotatable brush taken in the direction of lines 4-4 of FIG. 3 with the handle rotated at the hinge shown in FIG. 3 and retained in its folded position below the brush head.
Figure 7:
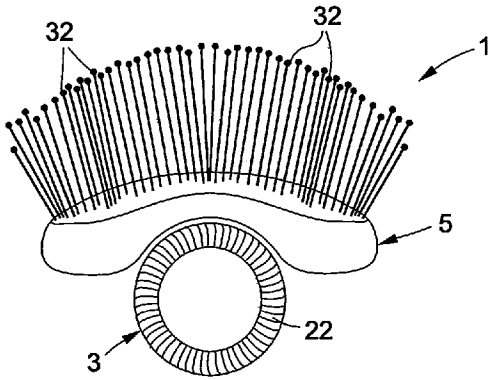
FIG. 7 is an end view of the rotatable brush taken in the direction of lines 7-7 of FIG. 3 showing the handle rotated to and retained in its folded position.
Figure 6:
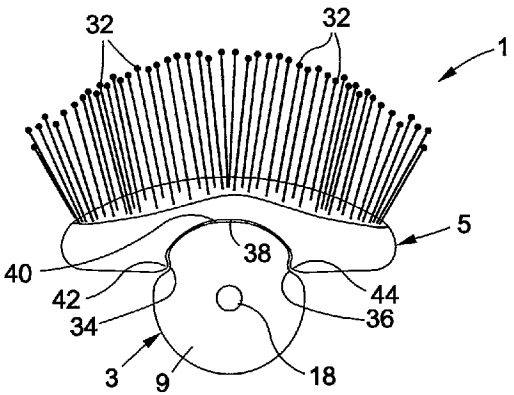
FIG. 6 is a cross-section of the brush head taken along lines 6-6 of FIG. 3 showing the handle rotated to and retained in its folded position.

The hinge 7 by which to couple the rotatable brush handle 3 to the brush head 5 is conventional. By way of example only, and as is best shown in FIG. 4, the hinge 7 includes cylindrical coupling sleeves 8-1 and 8-2. Coupling sleeves 8-1 are attached to the handle 3, and coupling sleeves 8-2 are attached to the brush head 5. The coupling sleeves 8-1 and 8-2 are axially aligned in an alternating fashion and a coupling pin (not shown) is located therethrough to establish an axle around which the brush handle 3 can rotate relative to the brush head 3. As represented by FIG. 5, the number of alternating coupling sleeves 8-1 and 8-2 which form the hinge 7 is a matter of choice and should not be regarded as a limitation of this invention.

The handle 3 of the rotatable brush 1 has an integral hollow fluid chamber 9 running therethrough. The fluid chamber 9 of handle 3 has an open end that is surrounded by a pair of cylindrical threaded fittings 10 and 12 (best shown in FIG. 2). One of the fittings 10 has a larger diameter than the other 12.

A conventional spray pump 14 is detachably connected to the handle 3 of brush 1 so as to communicate with the hollow fluid chamber 9 thereof. The spray pump 14 has pump head 16 and an elongated spray tube 18 extending therefrom. In the assembled brush configuration shown in FIG. 1, the spray tube 18 of spray pump 14 is removably received inside the hollow fluid chamber 9. In this same regard, the pump head 16 of spray pump 14 includes a cylindrical threaded fitting 20 that is coaxially aligned with respect to the elongated spray tube 18. With the spray tube 18 moved inside the fluid chamber 9, the threaded fitting 20 of pump head 16 is rotated into detachable mating engagement with the relatively narrow threaded fitting 12 around the open end of the fluid chamber 9 of the handle 3 of the rotatable brush 1.

Thus, it may be appreciated that the handle 3 of brush 1 performs the dual functions of a traditional brush handle to be grasped in the hand of a user when brushing his hair and that of a self-contained spray bottle from which a fluid is sprayed. To this end, the hollow fluid chamber 9 of handle 3 is filled with a fluid to be sprayed therefrom. The fluid may be water, a styling product or spray, or any other liquid to be applied to the user's hair or scalp prior to, during or after brushing. However, the fluid that is carried in and sprayed from the fluid chamber 9 is not limited to that to be applied to the user's hair.

The spray pump 14 detachably connected to the handle 3 is operated in a manner common to other spray pumps. That is, the pump head 16 is depressed a number of times to cause the fluid contents of fluid chamber 9 to be sprayed therefrom by way of the spray tube 18. The pump head 16 may be rotated out of its mating engagement with and detached from the open end of the hollow fluid chamber 9 of the handle 3 to permit the chamber 9 to be refilled with the same or a different fluid.

With the spray pump 14 detachably connected to the handle 3 of the rotatable brush 1 as previously described, an end cap 22 is removably attached to the handle 3 to surround the pump head 16 of spray pump 14. The end cap 22 has a cylindrical threaded end 24 that is sized to be rotated into mating engagement with the relatively wide threaded fitting 10 around the open end of the fluid chamber 9 of handle 3. When the end cap 22 is attached to handle 3, an enclosure is established to protect the pump head 16 and prevent an inadvertent activation thereof.

As an important feature of the brush 1, and as was previously disclosed, the handle 3 is rotatable relative to the brush head 5 between unfolded and folded positions. With the brush 1 in its unfolded position (of FIG. 1), the handle 3 and the brush head 5 are held end-to-end by a pair of complementary, generally S-shaped locking lips 28 and 30. The locking lips 28 and 30 snap together to detachably connect opposing ends of the handle 3 and the brush head 5 to one another. In this case the rotatable brush 1 can be used to pump fluid from the spray pump 14 thereof and/or to brush the user's hair. The brush head 3 is provided with an array of bristles 32 or the like which stand upwardly therefrom to brush the user's hair when the handle 3 is held in the user's hand. The bristles 32 may be connected directly to the brush head 3 or be glued to a (e.g., rubber) cushion liner 33 that lays against the brush head.

When the brush 1 is not in use and it is desirable to rotate the handle 3 to its compact folded position ideal for storage or for transport in the user's pocket or purse, the brush head 5 is held in one hand, and a rotational pushing force is applied in a first direction to the handle 3 with the other hand. Accordingly, the pair of locking lips 28 and 30 will be pulled apart so that the handle 3 can rotate around the hinge 7 relative to the brush head 5. More particularly, and as is best shown in FIG. 3, the brush handle 3 and the spray pump 14 carried thereby are rotated through an arc of about 180 degrees from the unfolded position (shown in broken lines and designated 3-1 and 14-1) extending outwardly from the brush head 5, past an intermediate position (shown in broken lines and designated 3-2 and 14-2) extending at a right angle downwardly from the brush head 5, and finally to the folded position located below the brush head 5.

As an important advantage of the rotatable brush 1 disclosed herein, the rotating handle 3 (in its folded position of FIG. 3) is adapted to be detachably coupled to and held underneath the brush head 5. To accomplish the foregoing advantage, a pair of longitudinally-extending grooves 34 and 36 (best shown in FIG. 2A) are formed (e.g., molded) along opposite sides of the handle 3. The grooves 34 and 36 are of sufficient length to establish a locking rib 38 therebetween at the bottom of handle 3.

Figure 2:
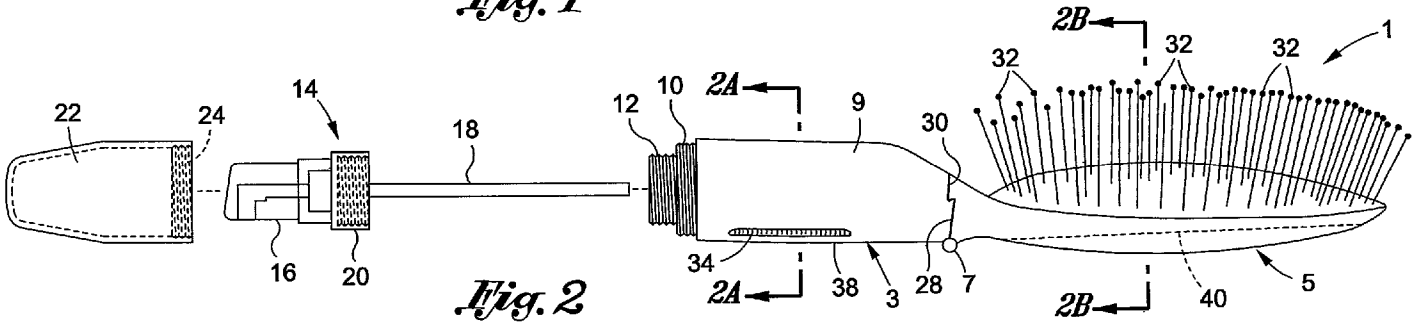
FIG. 2 is an exploded view of the rotatable brush of FIG. 1 to illustrate a spray pump detachably connected to the brush handle.
Figure 2B:
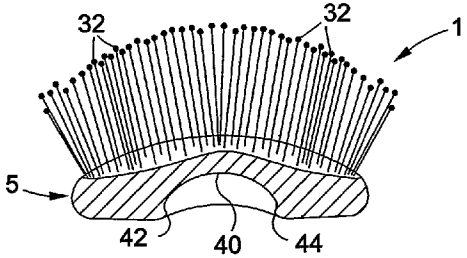
FIG. 2B is a cross-section of the brush head taken along lines 2B-2B of FIG. 2.
Figure 2A:
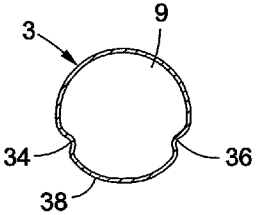
FIG. 2A is a cross-section of the brush handle taken along lines 2A-2A of FIG. 2.

The bottom of the brush head 5 has a locking cavity 40 formed (e.g., molded) therein (best shown in FIG. 2B). The locking cavity 40 is shaped with a pair of locking edges 42 and 44 running along opposite sides thereof. The locking edges 42 and 44 of cavity 40 are disposed in opposite facing alignment. The locking cavity 40 formed in the brush head 5 has a size, shape and location so as to receive and accommodate therewithin the locking rib 38 that is formed in the brush handle 3 and lies between the grooves 34 and 36 thereof.

More particularly, and referring now to FIGS. 3, 4, 6 and 7 of the drawings, the handle 3 of the rotatable brush 1 is shown rotated at hinge 7 to its folded position below the brush head 3 in response to the rotational force applied to handle 3. The same rotational force causes the locking rib 38 of handle 3 to be moved into receipt by the locking cavity 40 of the brush head 5. At the same time, the opposing locking edges 42 and 44 which run along the sides of cavity 40 and function as catches are snapped into detachable locking engagement with respective ones of the grooves 34 and 36 that are formed along the sides of the handle 3. By virtue of the foregoing, the brush handle 3 will be reliably retained in place underneath the brush head 5 to enable the rotatable brush 1 to have its aforementioned compact configuration at which to be especially suitable for storage or transport.

When it is desirable to return the rotatable brush 1 to its unfolded position of FIG. 1, a rotational pulling force is applied in an opposite direction to the handle 3, whereby the grooves 34 and 36 of the handle 3 are detached from their former engagement with the locking edges 42 and 44 of the brush head 5, and the locking rib 38 is removed from the locking cavity 40. The brush handle 3 is rotated in the opposite direction through an arc of approximately 180 degrees until the handle 3 and the brush head 5 are once again aligned end-to-end and the complementary pair of locking lips 28 and 30 are once again snapped together.

Figure 8:
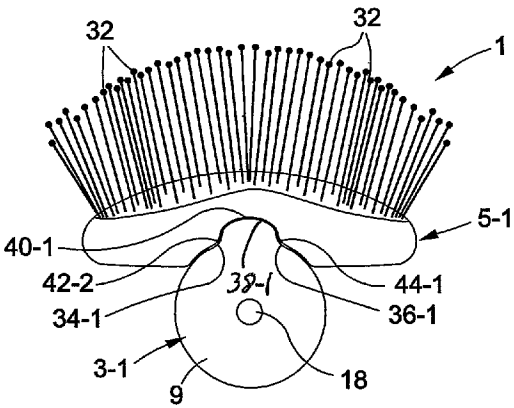
FIGS. 8-10 illustrate alternate preferred embodiments for a rotatable brush showing a handle rotated relative to and retained in a folded position below a brush head.

Turning to FIG. 8 of the drawings, an alternate embodiment is now disclosed to the rotatable brush 1 shown in FIGS. 1-7. In FIGS. 1-7, the pair of grooves 34 and 36 extend longitudinally along opposite sides of the brush handle 3 so that a relatively wide locking rib 38 extends therebetween for receipt within a correspondingly wide locking cavity 40 at the bottom of the brush head 5. However, the precise location of the grooves 5 formed in handle 3 is not to be considered a limitation of this invention.

To this end, FIG. 8 shows the pair of locking grooves 34-1 and 36-1 running longitudinally along the bottom of a modified handle 3-1 of a rotatable brush 5-1. In this embodiment, a relatively narrow locking rib 38-1 extends therebetween at the bottom of handle 3-1. When the modified handle 3-1 is rotated to its folded position below the brush head 5-1 as shown in FIG. 8, the relatively narrow locking rib 38-1 is removably received by a correspondingly narrow locking cavity 40-1 formed in the bottom of brush head 5-1. In this case, and as previously described, locking edges 42-1 and 44-1 which run along the sides of cavity 40-1 are snapped into detachable locking engagement with respective ones of the opposing grooves 34-1 and 36-1 so that the modified brush handle 3 will be conveniently retained in place underneath the brush head 5-1 in a compact folded configuration similar to that shown in FIG. 3.

Figure 10:
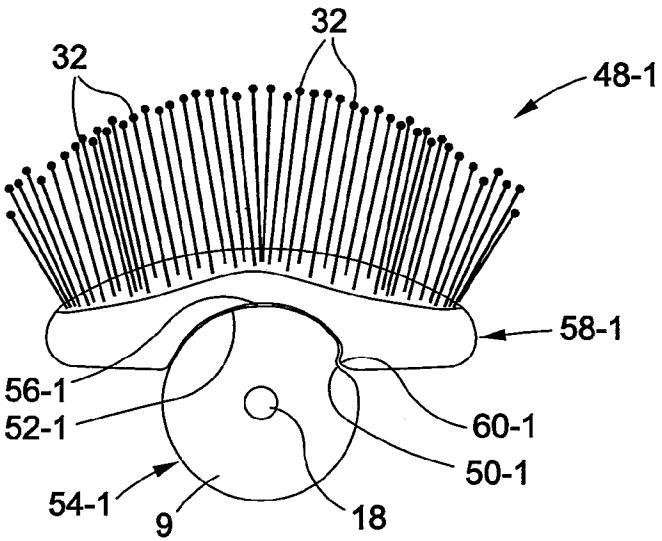
Figure 9:
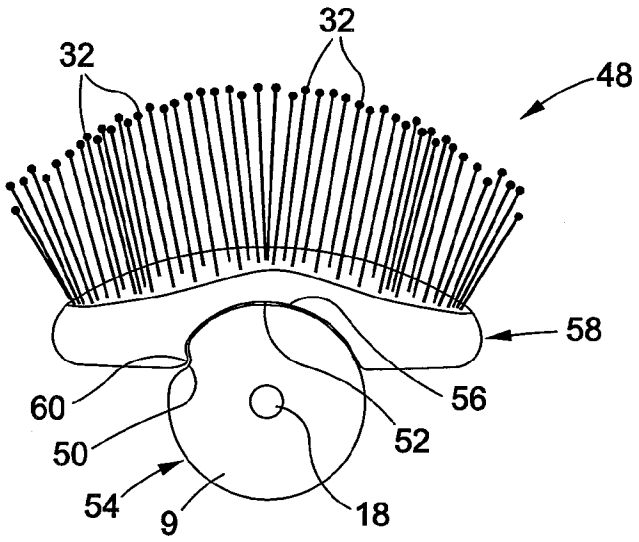

Other embodiments for a rotatable brush are disclosed while referring to FIGS. 9 and 10 of the drawings. In FIG. 9, the brush 1 of FIGS. 1-7 having a pair of grooves 34 and 36 running along the brush handle is replaced by a rotatable brush 48 having a single groove 50 running along one side of the brush handle 54. Thus, a locking rib 52 runs continuously around the bottom of the handle 54 for removable receipt within a corresponding sized and shaped locking cavity 56 at the bottom of the brush head 58. Likewise, a single locking edge 60 projects from the brush head 58 into the locking cavity 56 at which to be snapped into detachable locking engagement with the opposing groove 50 so that the brush handle 54 can be retained in the folded position underneath the brush head 58.

FIG. 10 shows a rotatable brush 48-1 that is substantially similar to the brush 48 shown in FIG. 9. That is, the brush 48-1 has a handle 54-1 that is rotatable relative to a brush head 58-1. In this case, however, a single groove 50-1 runs along the opposite side (with respect to the location of the groove 50 shown in FIG. 9) of brush handle 54-1. A locking rib 52-1 runs continuously around the bottom of the handle 54 for removable receipt within a locking cavity 56-1 at the bottom of brush head 58-1. Thus, a single locking edge 60-1 projects from the brush head 58-1 into the locking cavity 56-1 at which to be snapped into detachable locking engagement with the opposing groove 50-1 formed in brush head 58-1.

What is claimed is:

1. A rotatable brush, comprising:

a brush head having a set of bristles projecting therefrom to brush a contact surface;

a handle pivotally connected to said brush head to be held in the hand of a user to manipulate said brush head over the contact surface;

a hinge by which said handle is pivotally connected to said brush head so that said handle is rotatable relative to said brush head between an unfolded position lying end-to-end and axially aligned with said brush head and a folded position in which said handle overlaps and lies essentially parallel with said brush head;

said brush head has a bottom surface from which said bristles extend and a top surface located opposite to said bristles;

said top surface having a locking cavity formed therein for detachable mating engagement with a corresponding locking rib formed on a top surface of said handle.

2. The rotatable brush recited in claim 1, further comprising locking means by which to hold said brush head and said handle one above the other when said handle is rotated to said folded position.

3. The rotatable brush recited in claim 2, wherein said locking means includes a catch formed on said brush head, said handle moving into detachable mating engagement with said catch when said handle is rotated to said folded position.

4. The rotatable brush recited in claim 3, wherein said catch formed on the brush head includes at least one locking edge located at one side of said locking cavity, said at least one locking edge projecting into said locking cavity, and said handle moving into said detachable mating engagement with said at least one locking edge when said handle is rotated to said folded position and said locking rib is removably received within said locking cavity.

5. The rotatable brush recited in claim 4, wherein said catch formed on said brush head includes a pair of locking edges located at opposite sides of said locking cavity, said pair of locking edges projecting into said locking cavity, and said handle moving into said detachable mating engagement with said pair of locking edges when said handle is rotated to said folded position and said locking rib is removably received within said locking cavity.

6. The rotatable brush recited in claim 4, wherein said locking means also includes at least one locking groove formed in said handle adjacent said locking rib, said at least one locking groove of said handle snapping into said detachable mating engagement with said catch when said handle is rotated to said folded position and said locking rib is removably received within the locking cavity formed in said brush head.

7. The rotatable brush recited in claim 4, wherein said locking means also includes a pair of locking grooves formed in said handle at opposite sides of said locking rib, said pair of locking grooves snapping into said detachable mating engagement with said catch when said handle is rotated to said folded position and said locking rib is removably received within the locking cavity formed in said brush head.

8. The rotatable brush recited in claim 1, wherein said handle has a hollow fluid chamber, said brush further comprising a spray pump detachably connected to said handle and communicating with said hollow fluid chamber thereof.

9. The rotatable brush recited in claim 8, wherein said spray pump includes a pump head and a spray tube extending from said pump head and being removably received within the hollow fluid chamber of said handle.

10. The rotatable brush recited in claim 9, wherein said handle has an open end and a first threaded coupler extending therearound and the pump head of said spray pump has a second threaded coupler extending therearound, said first and second couplers being rotated into mating engagement with one another, whereby said spray pump is detachably connected to said handle.

11. A brush, comprising:

a brush head having a set of bristles projecting therefrom to brush a contact surface;

a handle pivotally connected to said brush head to be held in the hand of a user to manipulate said brush head over the contact surface, said handle having a hollow fluid chamber extending therethrough;

a spray pump being detachably connected to said handle and communicating with said hollow fluid chamber thereof;

a hinge by which said handle is pivotally connected to said brush head so that said handle is rotatable relative to said brush head between an unfolded position lying end-to-end and axially aligned with said brush head and a folded position in which said handle overlaps and lies essentially parallel with said brush head;

said brush head has a bottom surface from which said bristles extend and a top surface located opposite to said bristles;

said top surface having a locking cavity formed therein for detachable mating engagement with a corresponding locking rib formed on a top surface of said handle;

a first lock by which to hold said handle in said unfolded position lying end-to-end and axially aligned with said brush head; and a second lock by which to detachably connect said brush head to said handle one above the other when said handle is rotated to said folded position.

12. The brush recited in claim 11, wherein said first lock includes first and second locking lips located at respective opposing ends of said brush head and said handle, said locking lips being mated together to hold said handle in said unfolded position.

13. The brush recited in claim 1, wherein said second lock includes a locking groove formed on said handle and a catch formed on said brush head, said locking groove snapping into detachable mating engagement with said catch when said handle is rotated to said folded position.

* * * * *